US008274441B2

(12) United States Patent
Fruh et al.

(10) Patent No.: US 8,274,441 B2
(45) **Date of Patent: *Sep. 25, 2012**

(54) POSITIONING MECHANISM

(75) Inventors: Jason Matthew Fruh, Lone Tree, CO (US); Morgan Haden Kirby, Palmer Lake, CO (US)

(73) Assignee: EchoStar Technologies L.L.C., Englewood, CO (US)

( * ) Notice: Subject to any disclaimer, the term of this patent is extended or adjusted under 35 U.S.C. 154(b) by 31 days.

This patent is subject to a terminal disclaimer.

(21) Appl. No.: 13/004,814

(22) Filed: Jan. 11, 2011

(65) Prior Publication Data

US 2011/0102295 A1 May 5, 2011

Related U.S. Application Data

(63) Continuation of application No. 12/324,721, filed on Nov. 26, 2008, now Pat. No. 7,880,682.

(51) Int. Cl.
*H01Q 3/00* (2006.01)

(52) U.S. Cl. ..... 343/757; 343/878; 343/882; 343/892; 248/278; 248/288.11; 248/539

(58) Field of Classification Search ..... 343/757, 343/765, 878, 880, 882, 892; 248/278, 288.11, 248/299.1, 514, 539

See application file for complete search history.

(56) References Cited

U.S. PATENT DOCUMENTS

| | | | | | |
|---|---|---|---|---|---|
| 4,115,779 | A * | 9/1978 | Dantzler et al. | ..... | 343/715 |
| 4,804,971 | A | 2/1989 | Bruns et al. | ..... | 343/840 |
| 4,819,006 | A * | 4/1989 | Whitesides et al. | ..... | 343/880 |
| 5,020,765 | A * | 6/1991 | Evans et al. | ..... | 248/539 |
| 5,604,508 | A * | 2/1997 | Atkinson | ..... | 343/879 |
| 5,929,817 | A * | 7/1999 | Clark | ..... | 343/713 |
| 5,988,583 | A * | 11/1999 | Rhine | ..... | 248/536 |
| 6,538,612 | B1 | 3/2003 | King | ..... | 343/757 |
| 2005/0052335 | A1 | 3/2005 | Chen | ..... | 343/878 |
| 2010/0073256 | A1 | 3/2010 | Zihlman | ..... | 343/882 |

FOREIGN PATENT DOCUMENTS

| | | |
|---|---|---|
| WO | 99/41802 | 8/1999 |
| WO | 00/17955 | 3/2000 |

OTHER PUBLICATIONS

International Search Report, mailed Feb. 18, 2010, for counterpart PCT/US2009/065801, 12 pages.

Bracket system that includes CAD drawings corresponding to a bracket system that Applicant believes was publicly known before Nov. 26, 2008, 9 pages.

* cited by examiner

*Primary Examiner* — Tho G Phan

(74) *Attorney, Agent, or Firm* — Seed IP Law Group PLLC

(57) ABSTRACT

Antenna systems include adjustment mechanisms to adjust the position of dish antennas. The adjustment mechanism includes a clip, a bracket, and a cam mechanism. The clip is fixedly coupled to and projects outwardly from a mast. The bracket is pivotally coupled to the mast and is between the stationary clip and cam mechanism. The cam mechanism is pivotally coupled to the clip and positioned to rotate the bracket and the dish antenna as the cam mechanism rotates. The clip is made of a lightweight material to reduce the overall weight of the antenna system to enhance performance.

17 Claims, 19 Drawing Sheets

POSITIONING MECHANISM

CROSS-REFERENCE TO RELATED APPLICATION

This application is a continuation application of U.S. application Ser. No. 12/324,721, filed on Nov. 26, 2008. U.S. application Ser. No. 12/324,721 is incorporated herein by reference in its entirety.

BACKGROUND

1. Technical Field

The present disclosure generally relates to adjustment mechanisms for antennas and, more particularly, to adjustment mechanisms for dish antenna systems.

2. Description of the Related Art

Satellite dish antennas are commonly used in television receiving systems. A satellite dish antenna often has a dish-shaped receiver that collects and focuses incoming transmissions transmitted by a satellite. A parabolic surface of the dish-shaped receiver can reflect the transmissions to a waveguide, such as a feedhorn. Satellite dish antennas can be mounted on roofs, walls, residential structures, commercial buildings, or the like.

Satellite dish antennas can be highly directional antennas that are aimed at a desired broadcasting satellite in order to properly receive a transmission. There should be a clear line of sight between the satellite dish antenna and the satellite. Aiming is generally performed by adjusting an azimuth angle and an elevation angle using a complicated mechanical drive mechanism that drives the dish-receiver to a desired position. Conventional satellite dish antennas often have metal drive mechanisms that are relatively heavy and, thus, may contribute to fatigue problems, especially when the satellite dish antenna is exposed to cyclic loading, for example, during harsh weather conditions, such as during windstorms. Metal components of the drive mechanism are often susceptible to corrosion and other types of damage associated with outdoor use. For example, rain water can accumulate on the drive mechanism and can cause rusting. If the drive mechanism has internal components that are completely surrounded by a protective housing, a user may be unable to view those internal components to monitor operation of the drive mechanism. It may therefore be difficult to identify the cause of malfunctions.

BRIEF SUMMARY

Some embodiments disclosed herein are generally directed to an adjustment mechanism for positioning an antenna. The adjustment mechanism includes a clip for coupling to a mast and for engaging a cam mechanism. The cam mechanism is operable to adjust the position of the antenna. In some embodiments, the adjustment mechanism is configured for accurately adjusting the position of a dish of the antenna within a desired range of travel. Tuning can be performed based on a position of a transmitter, such as a satellite, sending signals to be received.

In certain embodiments, an adjustment mechanism is used for fine tuning of an antenna system along an azimuth plane or another plane, such as an elevation plane. A stationary clip of the adjustment mechanism is fixedly coupled to a stationary mast, such as a tubular mast. The clip and a backing structure of the adjustment mechanism retain a rotatable cam mechanism. The clip translationally fixes the cam mechanism to the mast. The cam mechanism, in some embodiments, has a cam positioned within a window of a bracket such that the bracket rotates about the mast as the cam mechanism rotates. The bracket can be sandwiched between the clip and the backing structure.

In some embodiments, an adjustment mechanism system includes a mast clip. The mast clip has two elongate members that slip over a mast when a bracket is installed on the mast. The elongate members are fixedly coupled to the mast. A threaded shaft of a cam mechanism extends through the mast clip. A bearing element of the cam mechanism makes contact with edges of a window defined in the backing structure. As the cam mechanism is rotated, the bearing element moves off center and pushes on the edges of the window to rotate the backing structure about the mast. The mast clip remains generally stationary with respect to the mast as the cam mechanism rotates. The backing structure, in some embodiments, supports a receiver and/or transmitter which correspondingly rotates. The cam mechanism is used to accurately adjust the position of a dish antenna to adjust peak signal strength.

DETAILED DESCRIPTION

Figure 1:
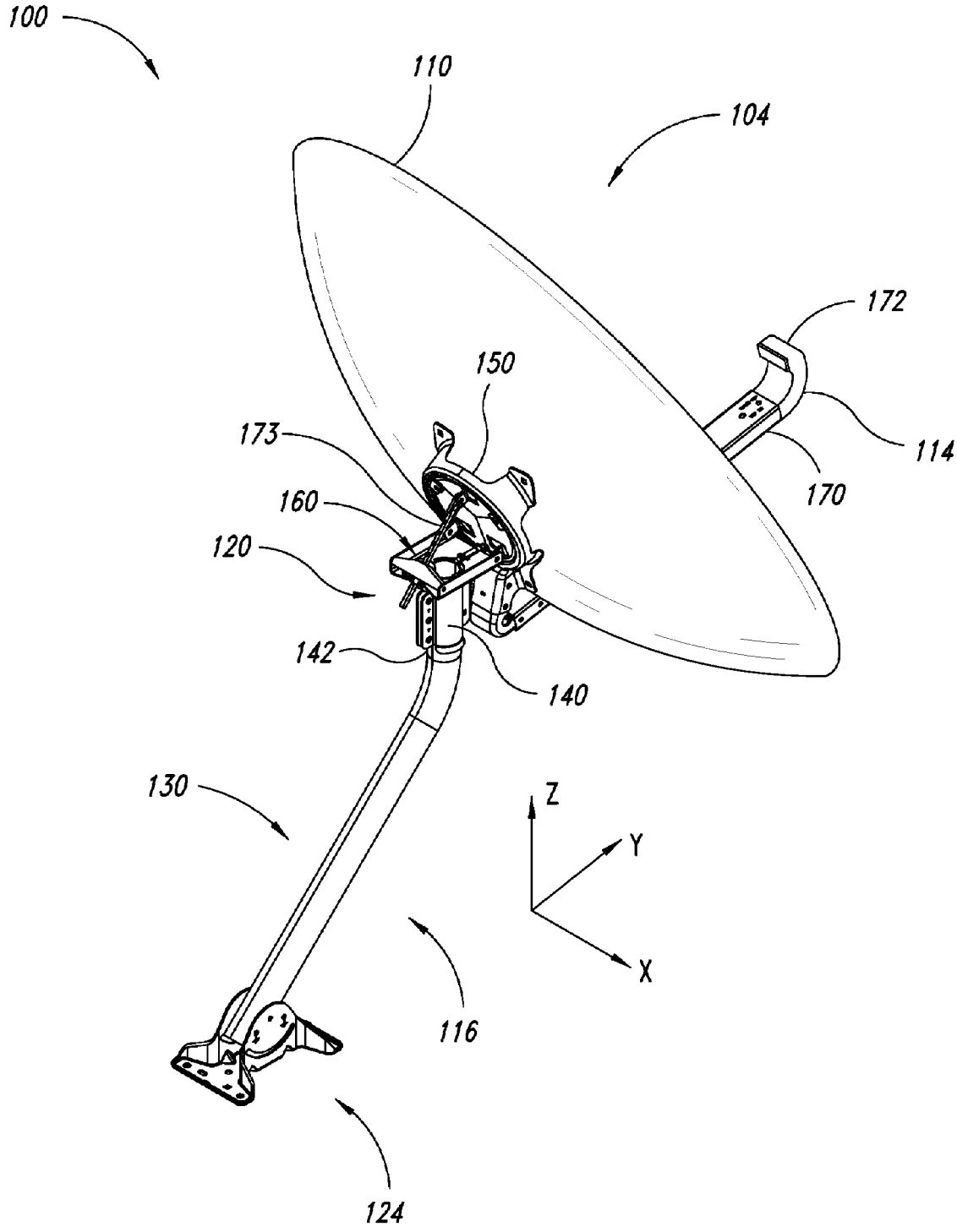
FIG. 1 is a pictorial view of an antenna system having a positioning mechanism for adjusting position settings.

FIG. 1 shows an antenna system 100 that includes a dish antenna 104 and a support assembly 116 supporting the dish antenna 104. The dish antenna 104 includes a dish 110 and a waveguide 114, illustrated as a feedhorn, positioned to communicate with the dish 110. The support assembly 116 includes a bracket mechanism 120, an anchoring bracket 124, and a mast 130 extending between the bracket mechanism 120 and the anchoring bracket 124. The bracket mechanism 120 connects the mast 130 to the dish antenna 104. The illustrated bracket mechanism 120 includes a mast mounting portion 140 coupled to an upper end 142 of the mast 130 and an antenna mounting portion 150 supporting the dish antenna 104. The antenna mounting portion 150 is rotatably coupled to the mast mounting portion 140 to adjust elevation settings.

The dish 110 is configured to transmit signals to and/or receive signals from one or more communication systems, such as one or more satellites. The dish 110 can be a circular or oval parabolic dish that reflects signals from a source and focuses the signals towards the feedhorn 114. The size, shape, and configuration of the dish 110 can be selected based on the type of signals to be received, position of the signal sources, configuration of the feedhorn 114, or the like.

An arm 170 extends outwardly away from the dish 110 and supports the feedhorn 114 and a processing unit 172. The feedhorn 114 collects signals from the dish 110 and delivers those signals to a processing system of the antenna system 100. The processing system can include, without limitation, one or more processing units, converters, amplifiers, adapters, feed devices, or the like. Converters can be low-noise block down converters. The amplifiers can be low-noise amplifiers. The processing unit 172 can include, without limitation, a low-noise block down converter, adaptors, or the like.

The bracket mechanism 120 can be used to selectively adjust an elevation angle, an azimuth angle, or the like. An elevation adjustment mechanism 173 of the bracket mechanism 120 can be used to adjust the elevation angle. These types of mechanisms are well known in the art. The anchoring bracket 124 can be coupled to a structure such that the illustrated X-axis and Z-axis correspond to an elevation axis and an azimuth axis, respectively. The bracket mechanism 120 is thus capable of rotating the dish antenna 104 about the X-axis to adjust the angle of elevation and about the Z-axis to adjust the azimuth angle.

Figure 2:
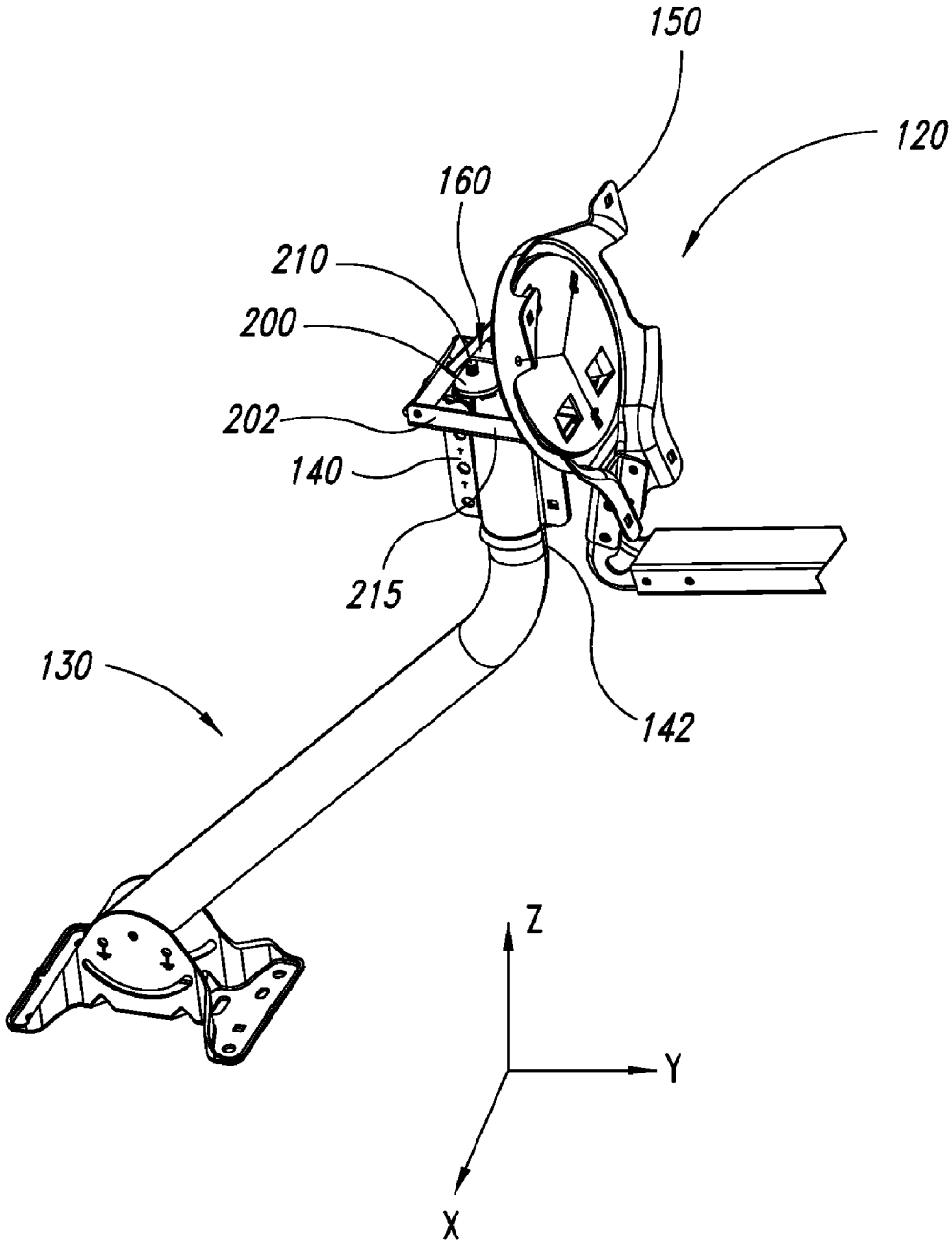
FIG. 2 is a pictorial view of a portion of the antenna system of FIG. 1.

Referring to FIG. 2, the bracket mechanism 120 further includes a positioning mechanism 160 (illustrated as an azimuth adjustment mechanism) adapted to adjust the azimuth angle of the dish antenna 104. A user can operate the adjustment mechanism 160 to controllably rotate the bracket mechanism 120 with respect to the mast 130.

Figure 3A:
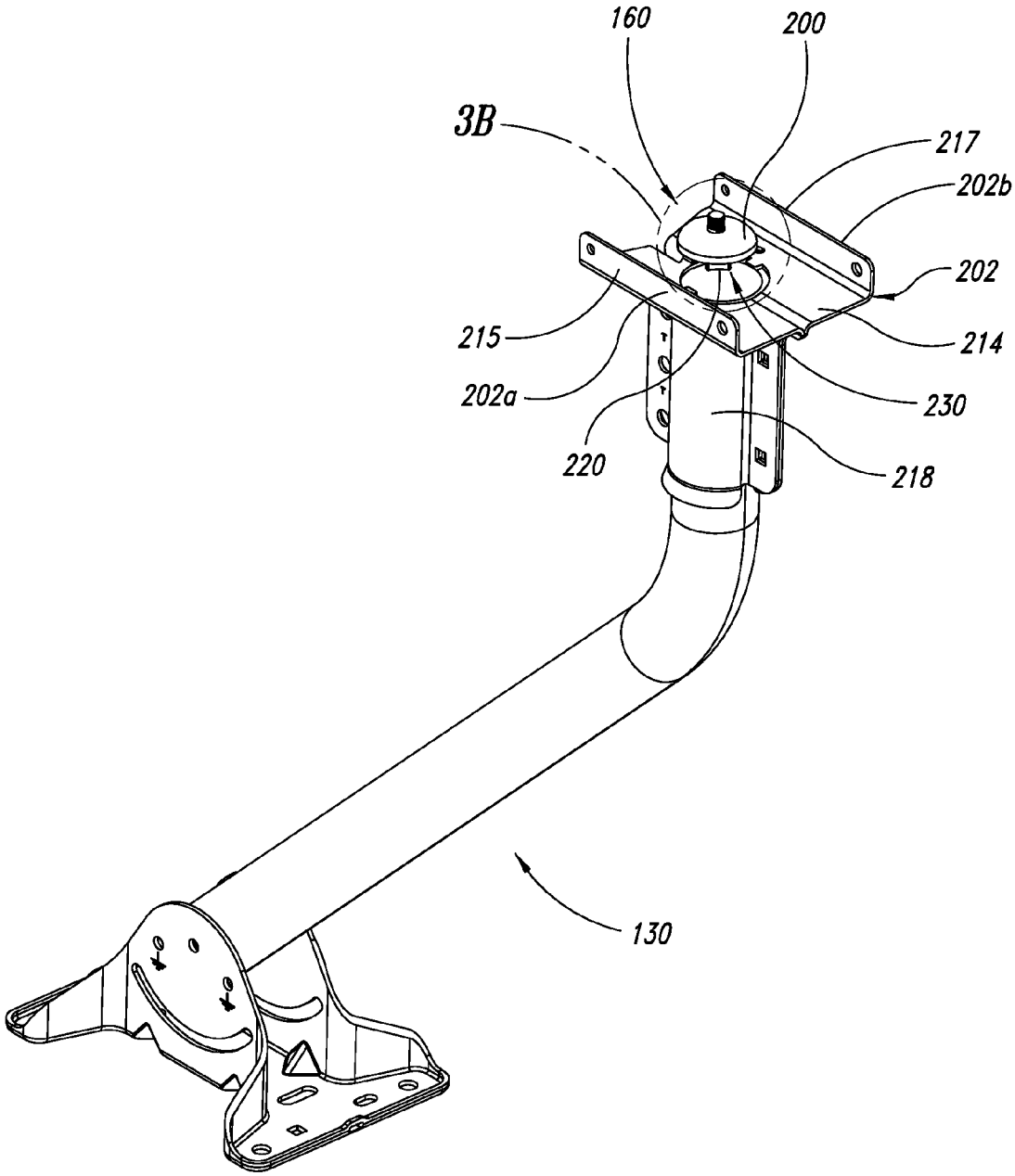
FIG. 3A is a pictorial view of a clip and a bracket coupled to a mast.
Figure 3B:
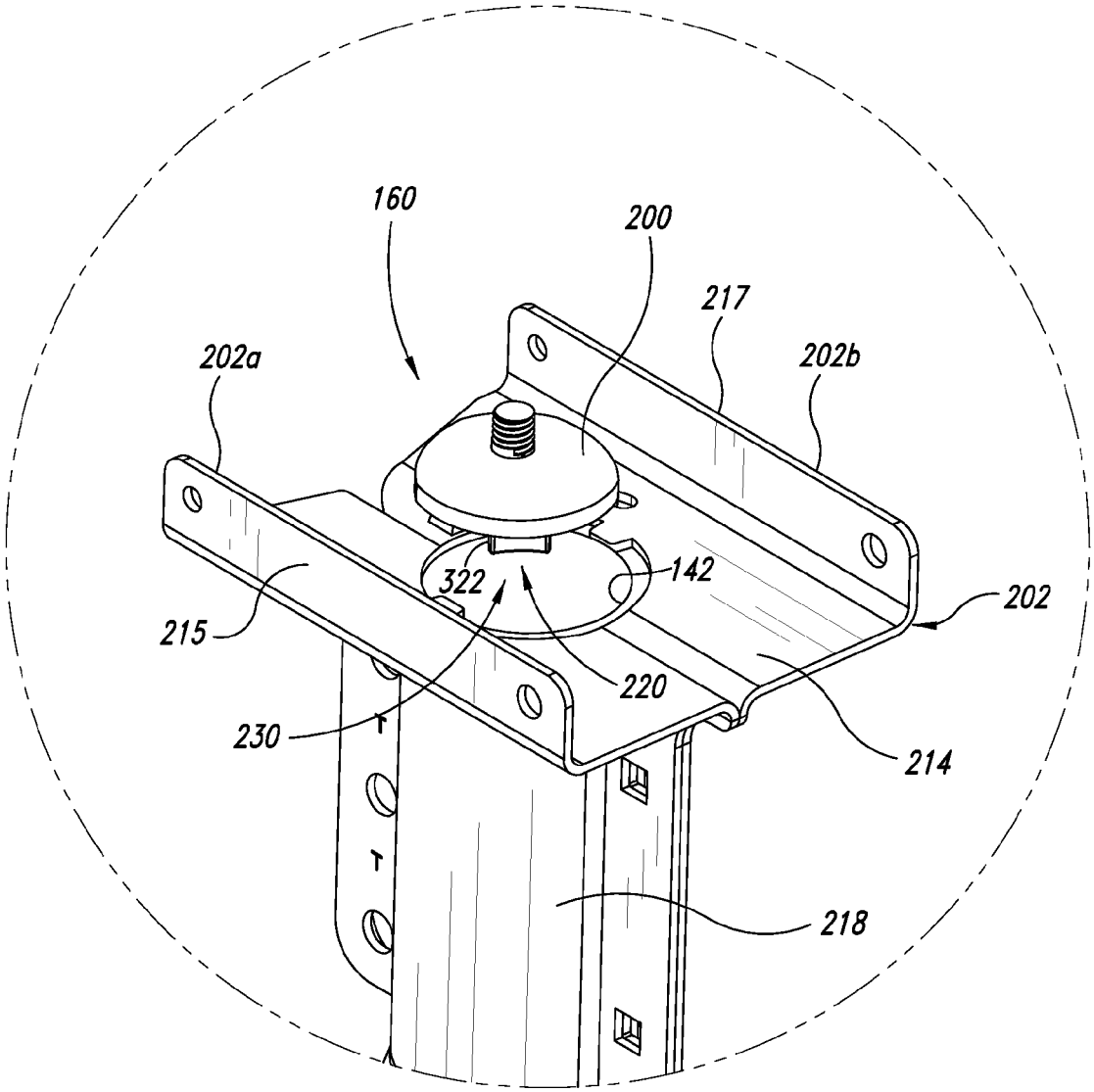
FIG. 3B is a detailed view of a retainer of the clip fixedly coupled to the mast.
Figure 4A:
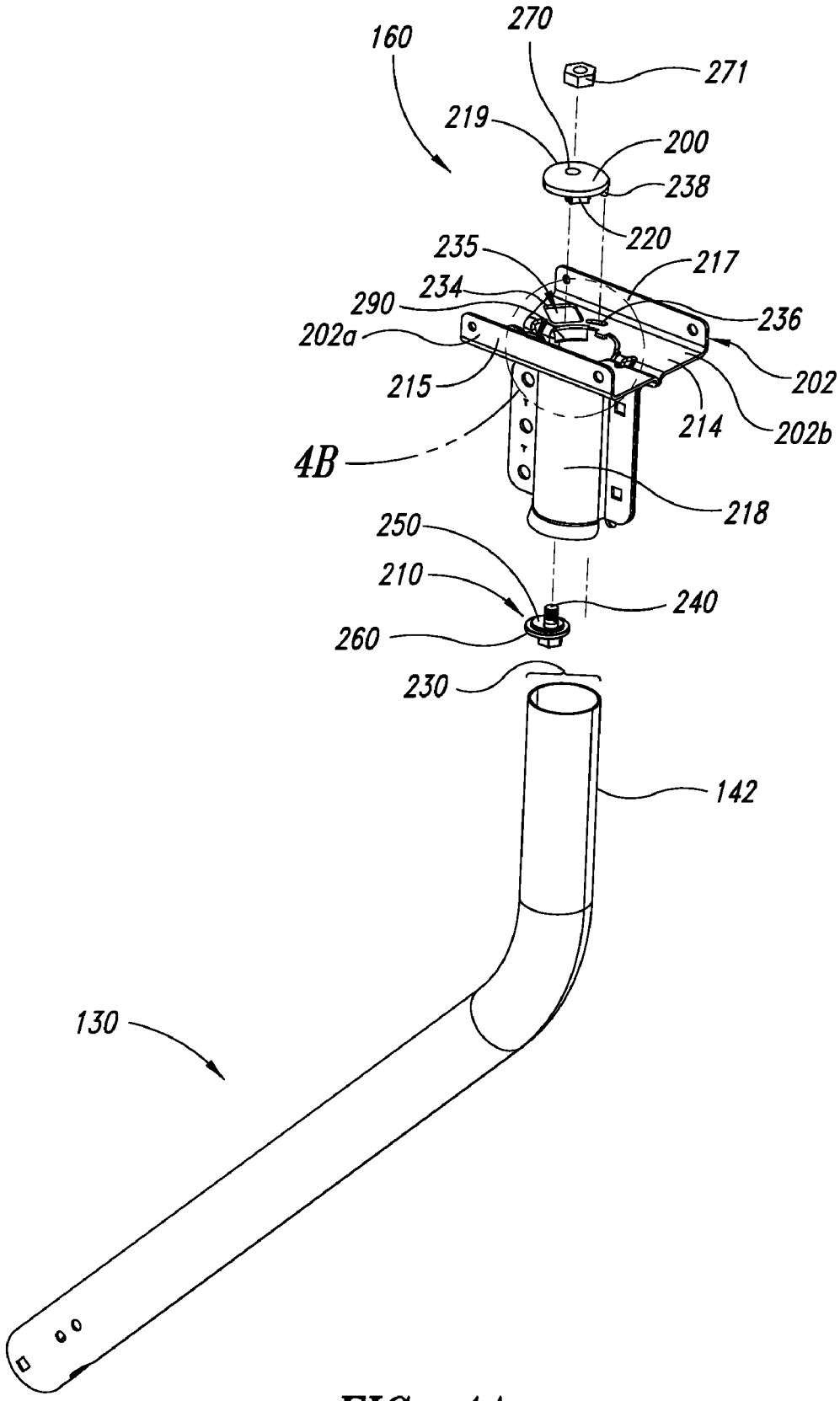
FIG. 4A is an exploded view of a portion of an antenna system of FIG. 3A.
Figure 4B:
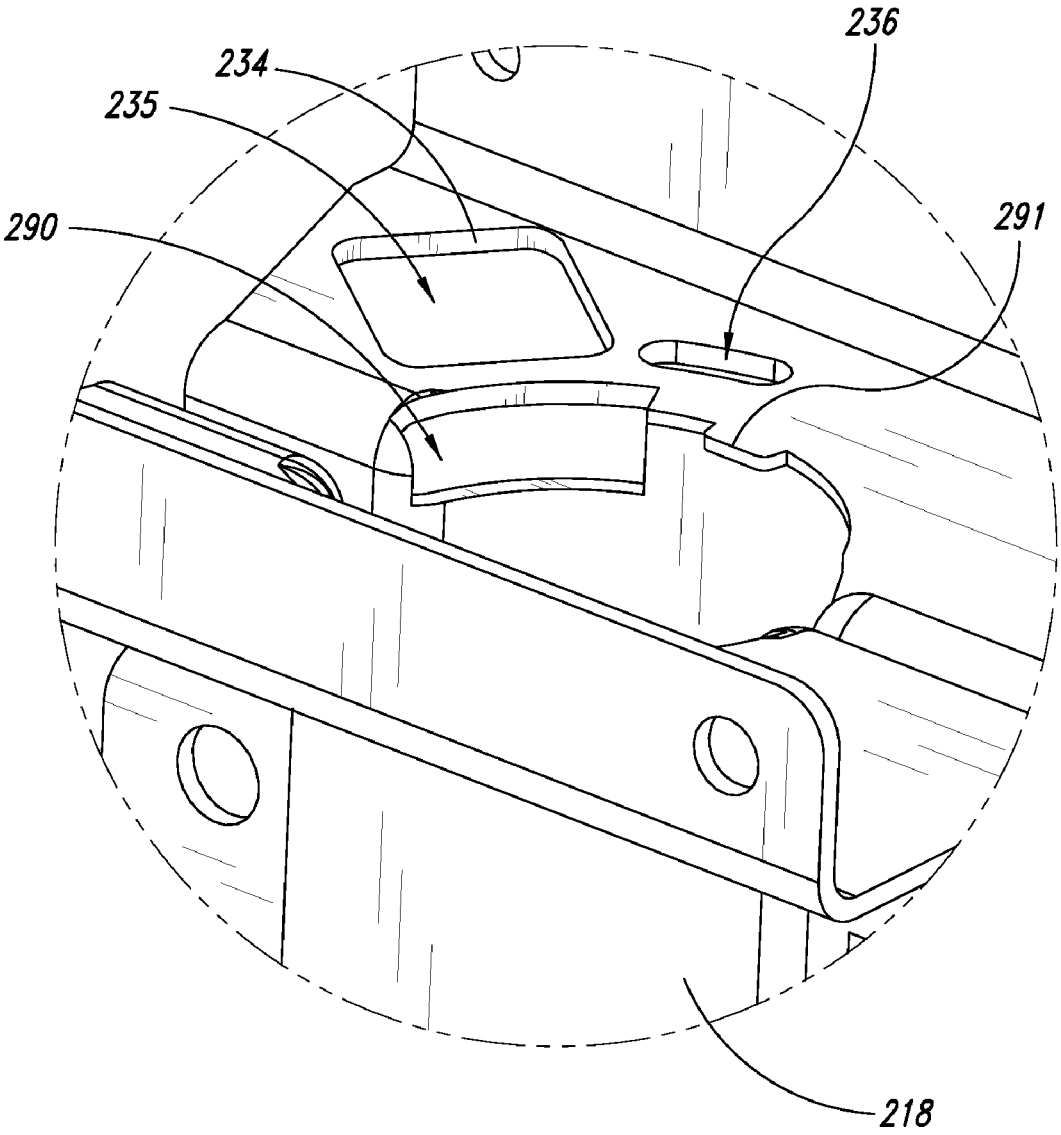
FIG. 4B is a detailed view of a bracket of the antenna system of FIG. 4A.

Referring to FIGS. 3A, 3B, and 4A, the adjustment mechanism 160 generally includes a clip 200, a bracket 202, and a cam mechanism 210 rotatably coupled to the clip 200 and positioned to physically contact the bracket 202 such that the dish antenna 104 rotates about the azimuth axis as the cam mechanism 210 rotates. The stationary clip 200 is fixedly coupled to the mast 130 and can be conveniently slid onto and off of the upper end 142 of the mast 130 to reposition the clip 200.

The bracket 202 is a multi-component bracket that includes a first portion 202A and a second portion 202B. The first and second portions 202A, 202B form an upper face 214 and a cylindrical sleeve 218 extending downwardly along the upper end 142 of the mast 130. The bracket 202 can be made, in whole or in part, of one or more metals, non-metal materials (e.g., plastic materials, composites, or the like), or other suitably rigid materials. The clip 200 is positioned above the face 214 and is between vertical sidewalls 215, 217 of the bracket 202. The illustrated clip 200 is spaced apart from the sidewalls 215, 217 such that a user can conveniently grasp the clip 200.

The clip 200 has a retainer 220 adapted to fixedly couple to a generally arcuate edge portion 230 of the upper end 142 of the mast 130. The bracket 202 includes a follower 234 in the form of a continuous edge defining a window 235. The window 235 has a generally rectangular shape and a width greater than a diameter of a cam 250, although the window 235 can also have other suitable shapes and configurations. An elongated slot 236 of the bracket 202 receives a protrusion 238 of the clip 200.

FIG. 4A shows the cam mechanism 210 including a shaft 240, the cam 250, and a backing structure 260. When assembled, the cam 250 is positioned in the window 235. The shaft 240 extends through an opening 270 of the clip 200. A free end 219 of the clip 200 is thus rotatably coupled to the shaft 240. A nut 271 is coupled to the shaft 240 to capture the window 235 of the bracket 202 between the clip 200 and the backing structure 260. The nut 271 can be tightened down to compress the bracket 202 between the clip 200 and the backing structure 260 to keep the cam 250 in the window 235.

Figure 5A:
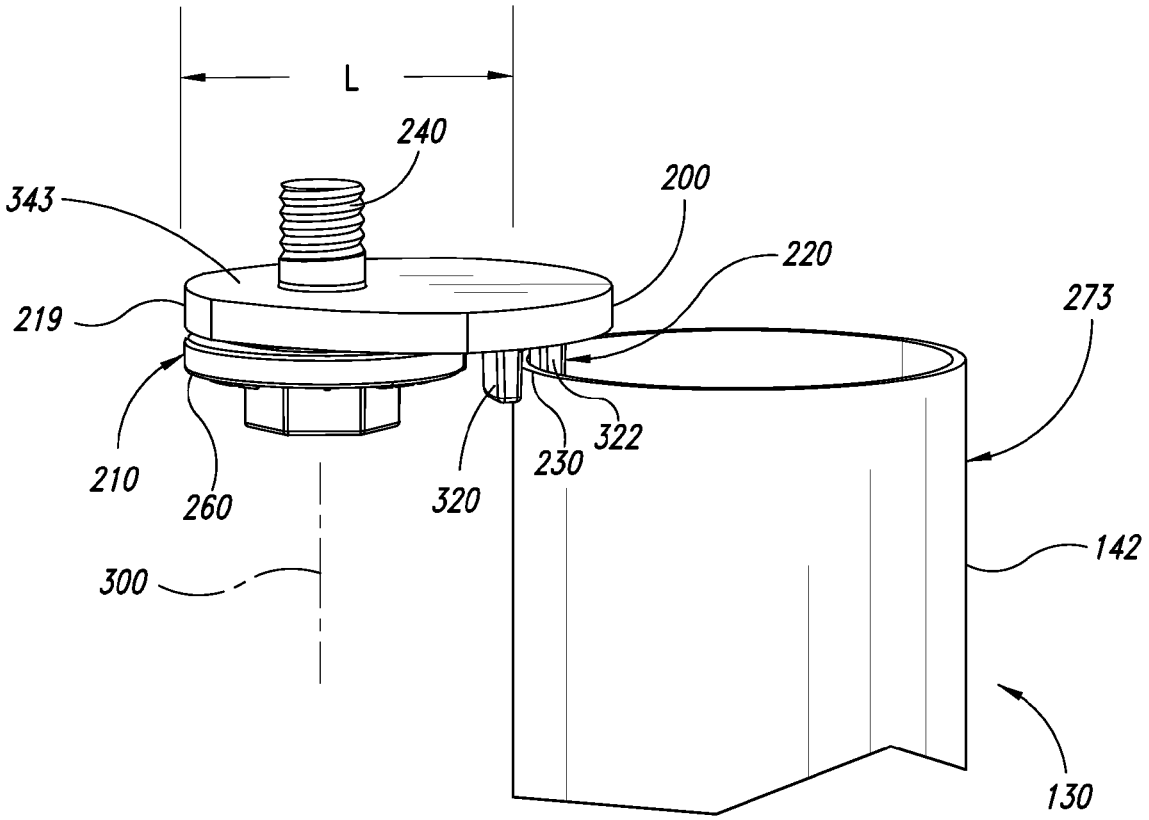
FIG. 5A is a pictorial view of a clip fixedly coupled to a mast and rotatably connected to a cam mechanism.

FIG. 5A shows the clip 200 coupled to the edge portion 230 in a cantilevered fashion. Most of the clip 200 projects outwardly beyond an outer surface 273 of the upper end 142. The retainer 220 has a first member 320 and a second member 322 that are on either side of the edge portion 230, which is a segment of the tubular upper end 142. In some embodiments, the retainer 220 surrounds 10%, 20%, or 40% of the circumference of the upper end 142. The edge portion 230 can be conveniently slid into the retainer 220 to produce an interference fit with members 320 and 322 of the retainer 220 to minimize, limit, or substantially eliminate relative movement between the clip 200 and the mast 130. In some embodiments, the interference fit keeps the clip 200 fixedly coupled to the mast 130 during alignment of the dish 110.

Referring to FIGS. 4A-5C, the upper end 142 of the mast 130 can be inserted into the sleeve 218 to position the edge portion 230 within a gap 290 of the bracket 202. The gap 290 is a cut-out that provides convenient access to the upper portion 230. The retainer 220 is placed on the upper portion 230 accessible via the gap 290. An inwardly protruding tab 291 (FIG. 5B) rests on the upper portion 230 to allow the bracket 202 to rotate with respect to the mast 130.

Figure 5B:
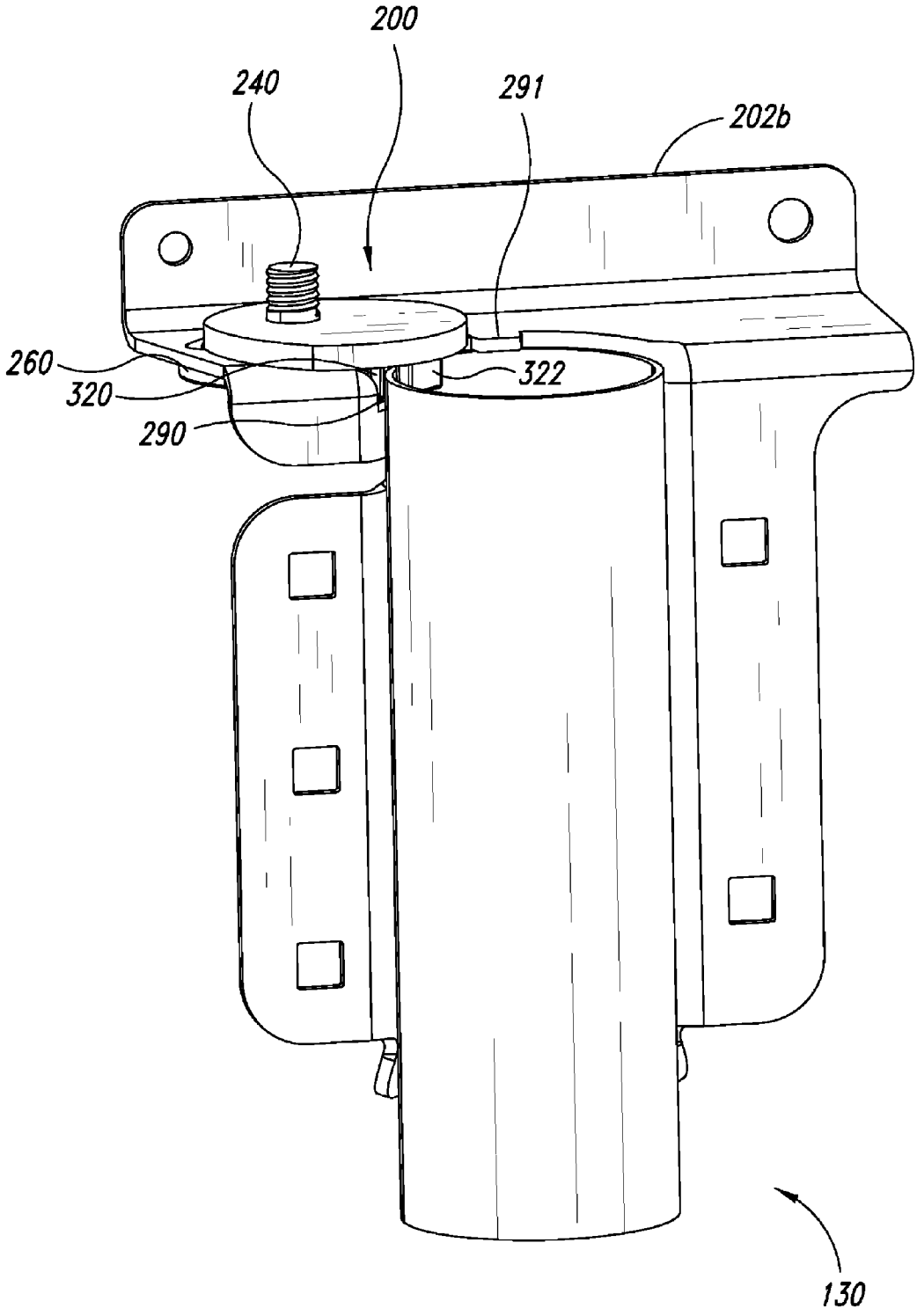
FIGS. 5B and 5C are pictorial views of a section of a bracket, a clip, and a mast.
Figure 5C:
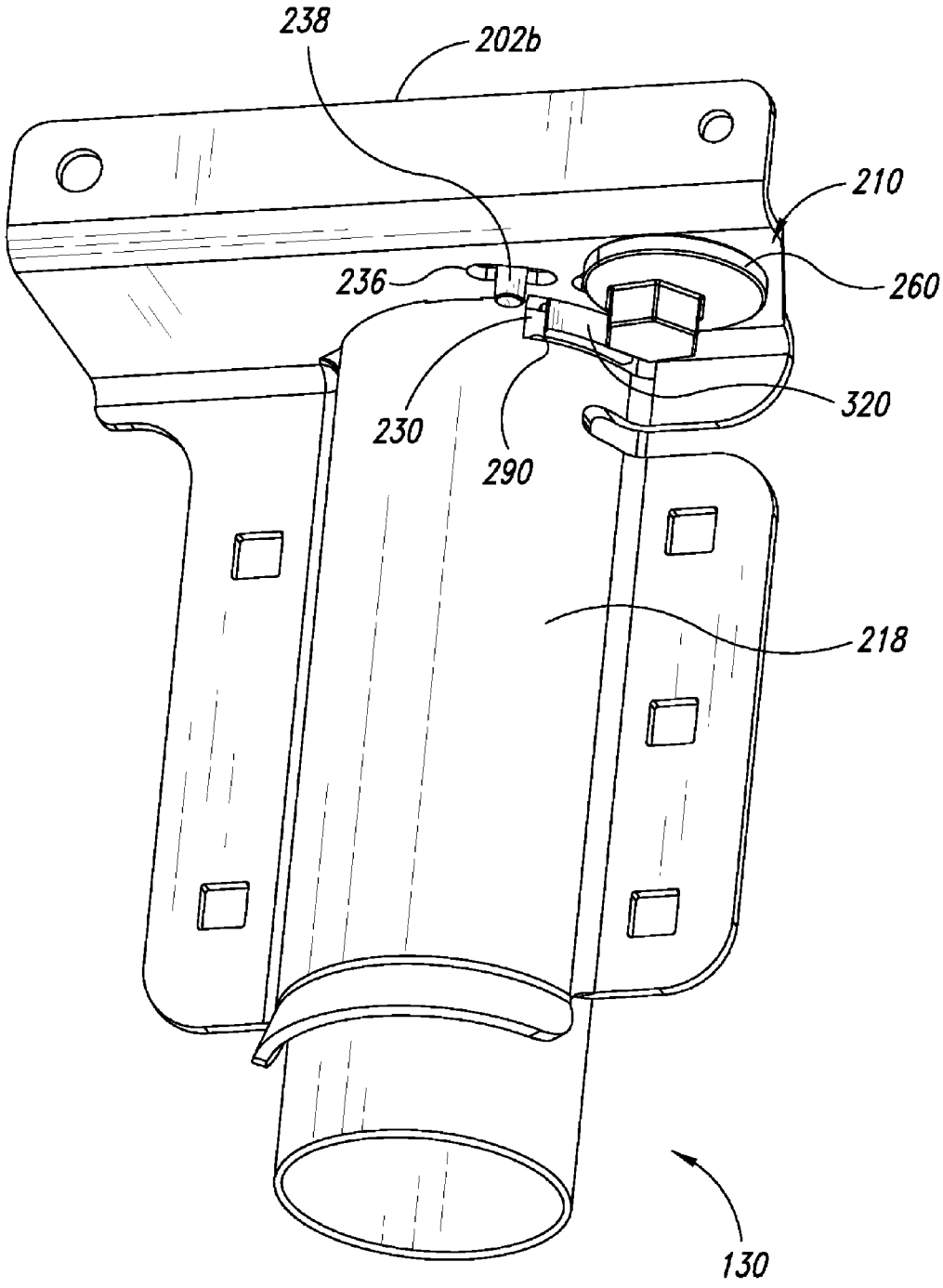

Referring to FIGS. 4A, 4B, 5B, and 5C, the gap 290 is sized to allow rotation of the bracket 202 while the clip 200 remains fixedly coupled to the mast 130. The illustrated gap 290 has a length that is greater than the length of the first member 320 of the retainer 220. As shown in FIG. 5C, the retainer 220 is visible from beneath the bracket 202, thereby allowing evaluation of the position of the retainer 220 with respect to the gap 290 and/or the mast 130.

Referring again to FIG. 5A, a portion 343 of the clip 200 extends outwardly from the upper end 142 and has a longitudinal length L. In some embodiments, a substantial portion of the portion 343 is positioned between the upper end 142 and the shaft 240. For example, at least 40%, 60%, 80%, or 90% of the length L of the portion 343 can be between the shaft 240 and the upper end 142. In some embodiments, including the illustrated embodiment of FIG. 5A, most of the portion 343 is located between the retainer 220 and the shaft 240. The shaft 240 is thus closer to the free end 219 of the clip 200 than the upper end 142. The clip 200 has a width W (see FIG. 8) that is less than an inner diameter of the tubular mast 130. Most or substantially all of the upper edge of the mast 130 is directly beneath the clip 200.

Figure 6:
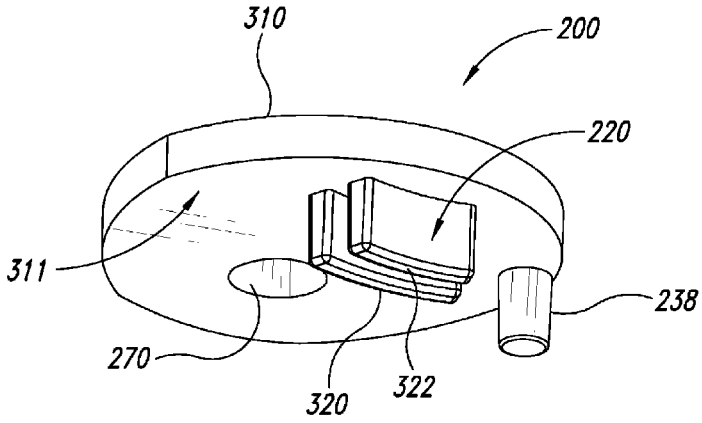
FIG. 6 is a pictorial view of a clip.
Figure 7:
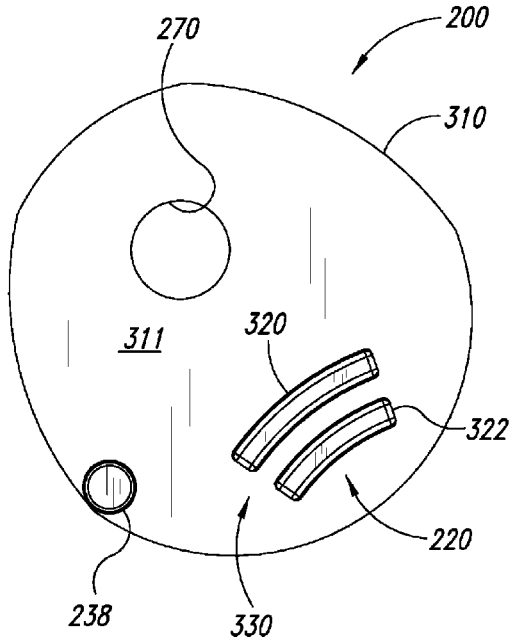
FIG. 7 is a bottom view of the clip of FIG. 6.
Figure 8:
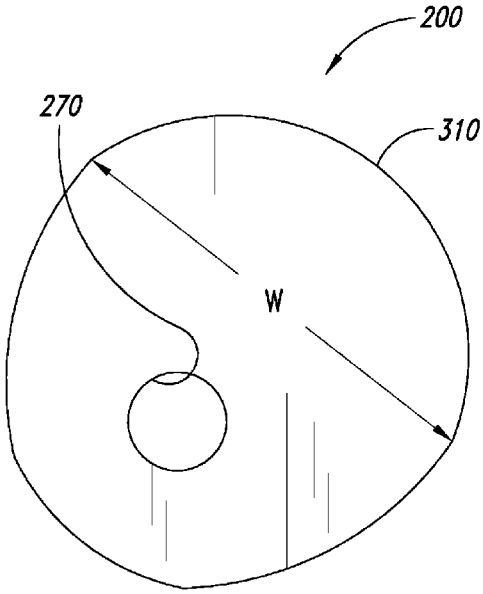
FIG. 8 is a plan view of the clip of FIG. 6.

Referring to FIGS. 6-8, a main body 310 of the clip 200 is integrally connected to the retainer 220 and the protrusion 238. The main body 310 is a rigid and generally planar member defining the opening 270, illustrated as a through-hole. The protrusion 238 is a cylindrical member extending downwardly from the main body 310 and has a length sufficient to extend into the slot 236 of the bracket 202.

The retainer 220 includes the first member 320, the second member 322, and an elongate slot 330 defined by the first and second members 320, 322. The first member 320 and the second member 322 extend generally perpendicularly from a lower surface 311 of the main body 310. As shown in FIGS. 5B and 5C, the first member 320 is positioned in the gap 290.

The members 320, 322 can be arcuate tabs having curvatures that are generally similar to the curvature of the edge portion 230. The shape of the slot 330 can thus be substantially similar to a shape of the edge portion 230. The members 320, 322 can be positioned on the exterior and interior sides, respectively, of a tubular sidewall of the mast 130.

The slot 330 of FIGS. 6-8 has a partially-circular configuration with a radius of curvature that is generally equal to the radius of curvature of the edge portion 230. In some embodiments, the upper edge portion 230 can have a generally linear configuration. For example, the upper end 142 can include an arcuate portion and a linear portion. The first and second members 320, 322 can be generally planar members for coupling to the linear portion.

The illustrated clip 200 has a one-piece construction to minimize, eliminate, or substantially prevent relative movement between features of the clip 200. In some embodiments, the retainer 220 and the protrusion 238 can be integrally formed with the main body 310 using a molding process, such as an injection molding process, compression molding process, or the like. Different types of manufacturing processes can be used to manufacture the clip 200. In some embodiments, the clip 200 is a unitary clip made from plastic using a milling or machining process.

The clip 200 can be made, in whole or in part, of a lightweight material to reduce the overall weight of the antenna system 100, thereby enhancing performance, such as fatigue performance. For example, the reduction in weight can reduce the loads applied to various components, including the mast 130, mast mounting portion 140, or the like. Plastic material can be used to form at least 50% by weight of such a light weight clip 200. In some embodiments, the clip 200 comprises at least about 60%, 80%, 90%, or 95% by weight of a plastic material. The plastic material can include, without limitation, polyethylene, polypropylene, polyvinyl chloride, acrylic, polyester, nylon, or combinations thereof. In some embodiments, the clip 200 comprises mostly a first material by weight and the bracket 202 comprises mostly a second material by weight that is different from the first material. The first and second materials can be plastic and metal (e.g., steel or aluminum), respectively. The plastic clip 200 can be used in relatively harsh environments without corroding, in contrast to metal components of traditional antenna systems.

Figure 9:
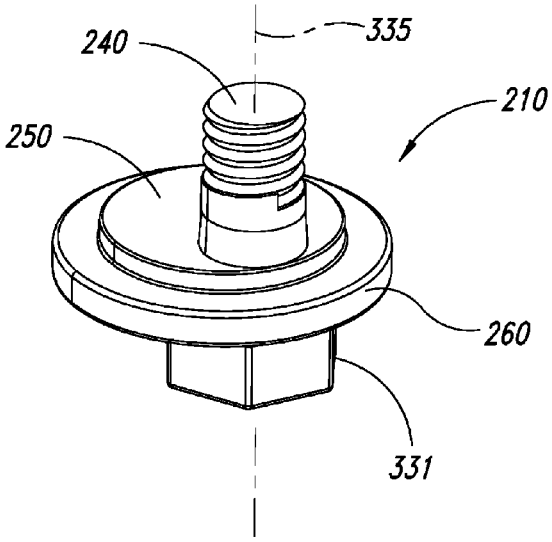
FIG. 9 is a pictorial view of a cam mechanism.
Figure 10:
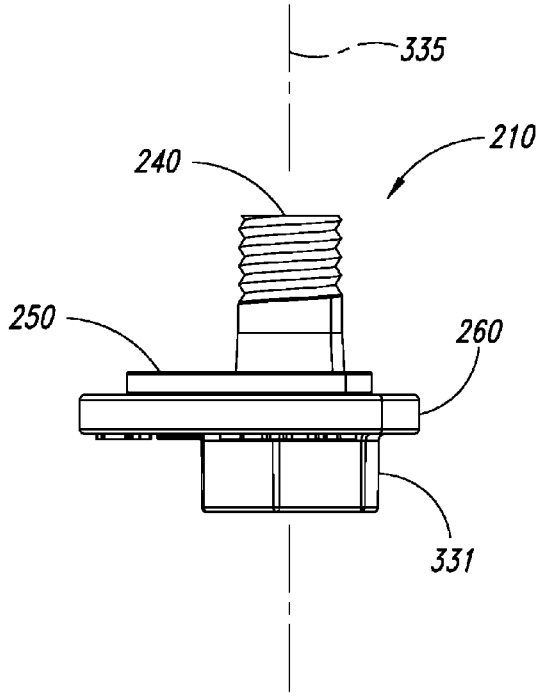
FIG. 10 is a side elevational view of the cam mechanism of FIG. 9.
Figure 11:
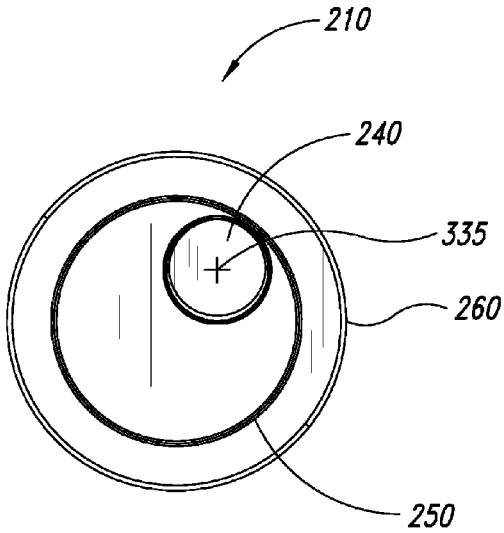
FIG. 11 is a plan view of the cam mechanism of FIG. 9.

FIGS. 9-11 show the cam mechanism 210 including the shaft 240 extending upwardly away from the cam 250. The shaft 240 has external threads that mate with internal threads of the nut 271. The cam 250 is positioned between the shaft 240 and the back support 260. As shown in FIG. 11, the shaft 240 is eccentrically mounted on the cam 250, which has a generally circular profile as viewed from above. The back support 260 is between the cam 250 and a knob 331.

FIGS. 12A-15 illustrate one method of using the adjustment mechanism 160 with the stationary clip 200 to move the bracket 202 to adjust the azimuth position of the dish 110. Many components of the bracket 202 have been removed for clarity. The cam 250 in the window 235 can be manually rotated to move the dish 110. The dish 110 rotates about an azimuth axis 400 as the cam 250 rotates eccentrically about an axis of rotation 335 to drive the dish antenna 104 back and forth. After the dish 110 is in the desired position, a nut (shown removed in FIGS. 12A-15) is rotated to lock the bracket 202 between the back support 260 and the clip 200. In this manner, the dish antenna 104 is fixed with respect to the mast 130. The nut can be loosened to reposition the dish antenna 104, if needed or desired.

Figure 12A:
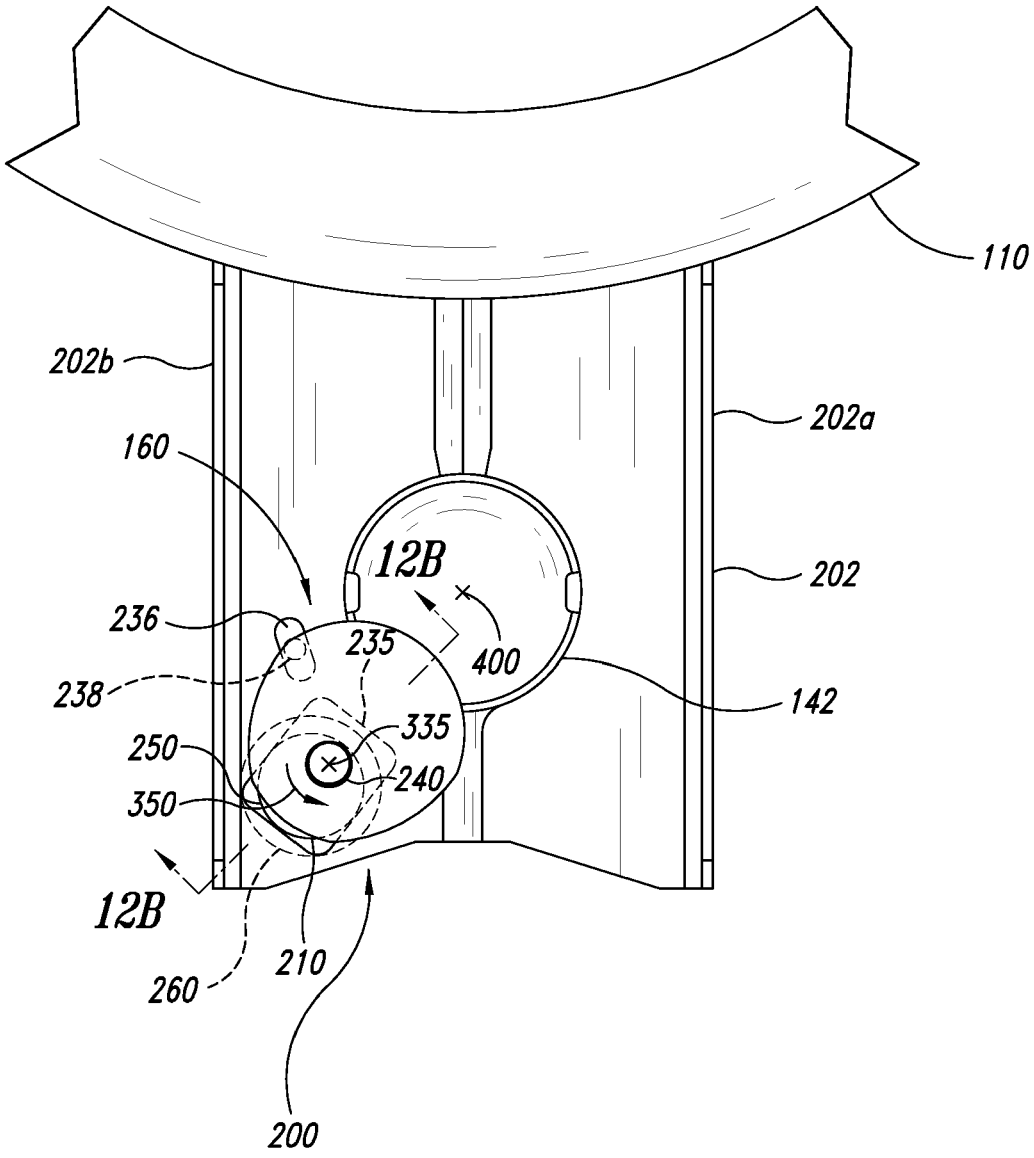
FIGS. 12A-15 illustrate one method of operating the positioning mechanism of an antenna system.
Figure 12B:
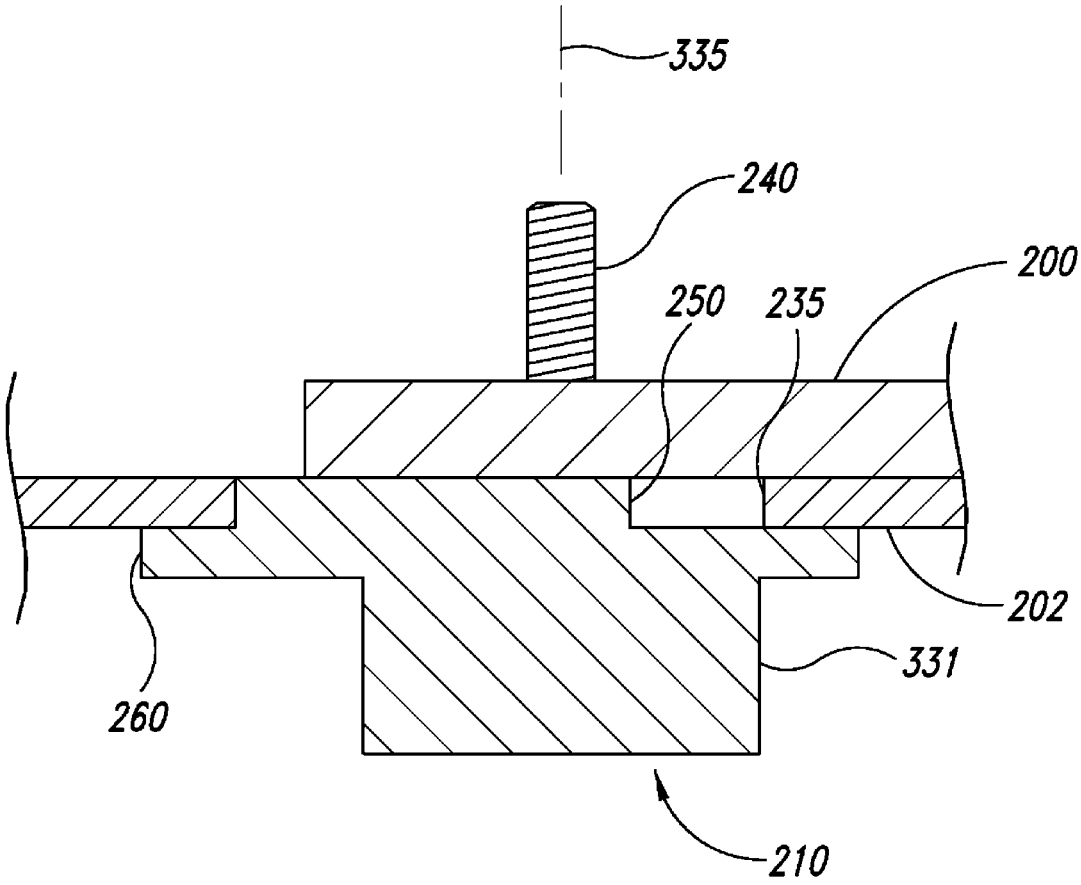

FIG. 12A is a plan view of the adjustment mechanism 160. The cam mechanism 210 is rotated counterclockwise to move the bracket 202 carrying the dish antenna 104 counterclockwise about the azimuth axis 400. A user manually rotates the knob 331 positioned underneath the bracket 202 to rotate the cam 250 in the counterclockwise direction, as indicated by the arrow 350. FIG. 12A shows the cam 250 positioned in the window 235. The cam 250 pushes the bracket 202 counterclockwise. As the bracket 202 rotates, the protrusion 238 slides along the slot 236 to ensure that the bracket 202 swivels smoothly about the mast 230. The cam 250 can protrude laterally outward from the clip 200. When a user adjusts the position of the dish antenna 104, the user can therefore visually inspect the movement of the cam 250. In the illustrated embodiment, a portion of the cam 250 is visible from above when the bracket 202 is near or in the illustrated initial position.

Figure 13:
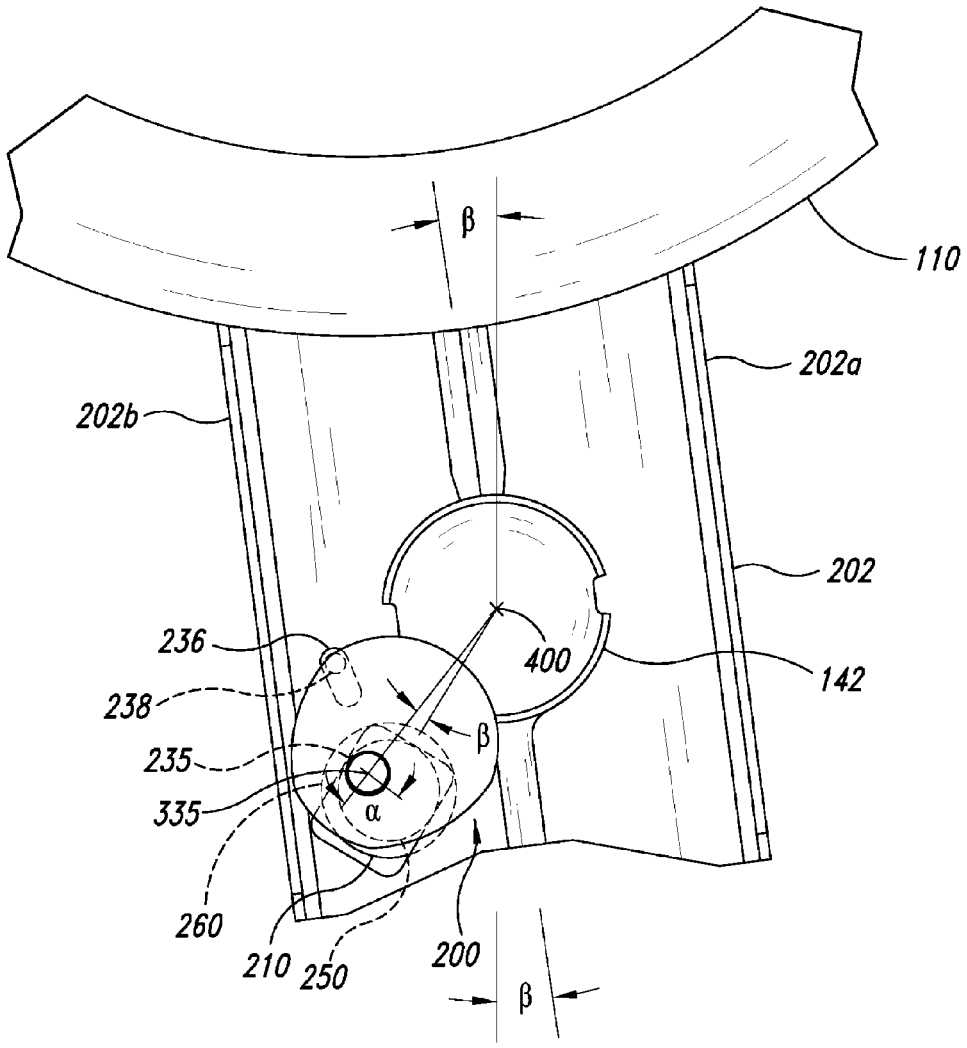

FIG. 13 shows the rotated bracket 202. The cam mechanism 210 has been rotated an angle $\alpha$ such that the cam 250 rotated the bracket 202 and dish 110 an angle $\beta$ about the azimuth axis 400. The illustrated angle $\alpha$ is about 90 degrees and the angle $\beta$ is less than about 10 degrees. A ratio of the angle $\alpha$ to the angle $\beta$ is greater than or equal to about 5, 10, 20, or 30. The angle $\beta$ can be less than or equal to 5 degrees, 10 degrees, 20 degrees, 30 degrees, or 40 degrees, or ranges encompassing such angles. The cam 250 is well suited for fine adjustments of the azimuth settings to accurately increase the peak signal.

Figure 14:
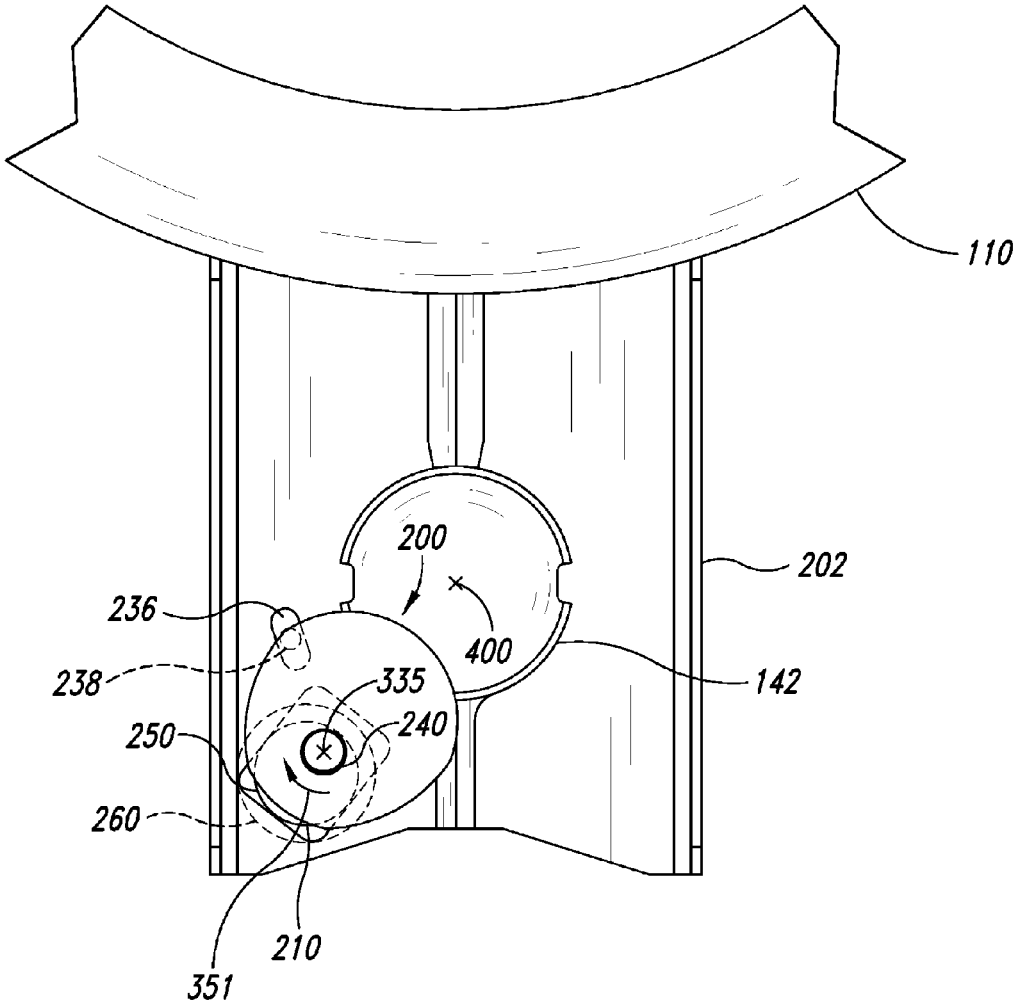
Figure 15:
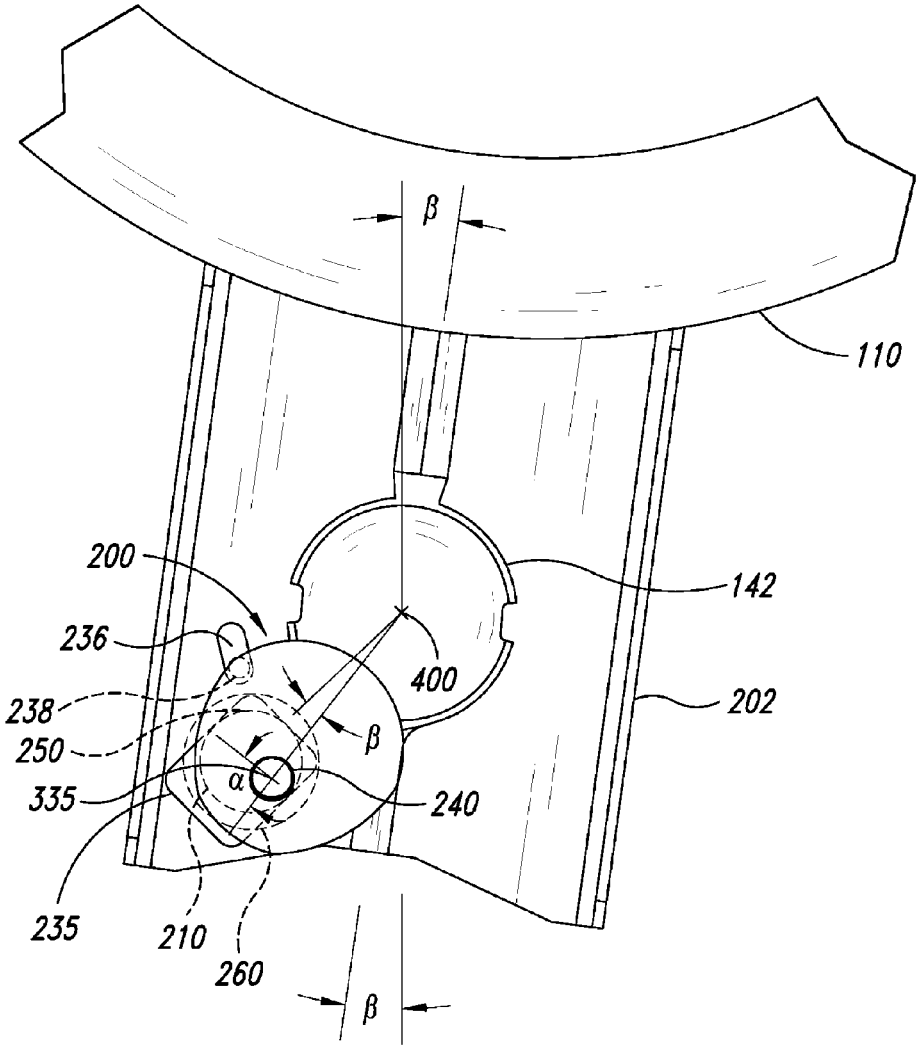

The cam mechanism 210 of FIG. 13 can be rotated clockwise to return the bracket 202 to the initial position. FIG. 14 shows the bracket 202 after it has been returned to the initial position. The cam mechanism 210 of FIG. 14 can be rotated clockwise, as indicated by an arrow 351, to rotate the bracket 202 about the azimuth axis 400 in the clockwise direction. FIG. 15 shows the bracket 202 after the cam mechanism 210 of FIG. 14 has been rotated clockwise about 90 degrees. In this manner, the cam 250 can be rotated about 180 degrees with respect to the shaft 240 to rotate the dish 110 an angle of about 5 degrees, 10 degrees, 15 degrees, 20 degrees, or ranges encompassing such angles.

The antenna systems disclosed herein may undergo different types of loading, including wind loading. Wind loading occurs when air pushes on the antenna system and may cause the dish 110 to become misaligned. The adjustment mechanism 160 can be conveniently accessed and operated to return the directional dish 110 to the desired position. Additionally, the clip 200 can be quickly repositioned with respect to the mast 130 to ensure that the cam 250 is properly positioned in the window 235. The clip 200 can be slid onto and off of the mast 130 any number of times to ensure proper positioning.

The clip 200, in some embodiments, extends over less than about 40%, 30%, 25%, or 20% of the bracket 202. The contact interface between the clip 200 and the bracket 202 can be relatively low to prevent wear along most of the bracket 202. The clip 200 can also be made of a material that does not facilitate corrosion of the bracket 202. Additionally, various portions of the cam mechanism 210 can be conveniently viewed during operation to monitor operation.

Figure 16:
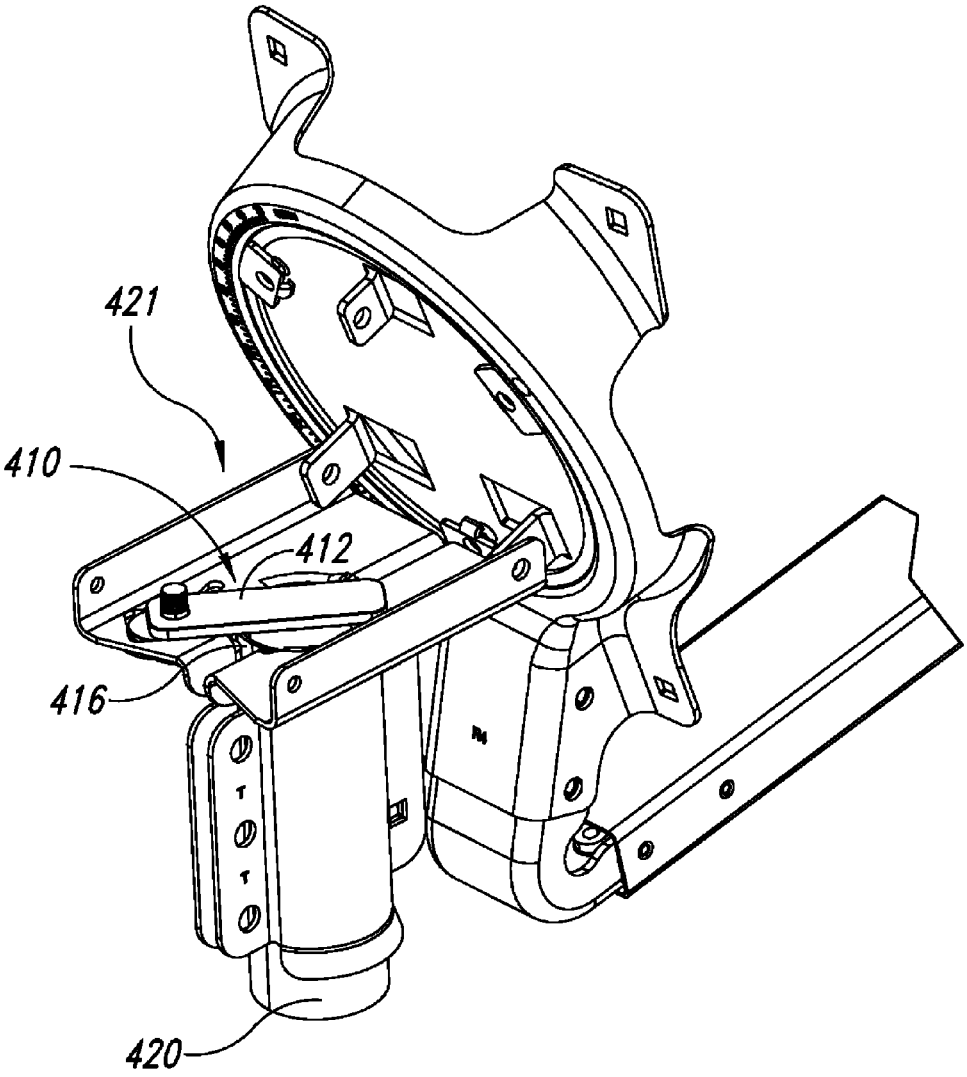
FIGS. 16 and 17 are pictorial views of a positioning mechanism of an alternative embodiment of an antenna system.
Figure 17:
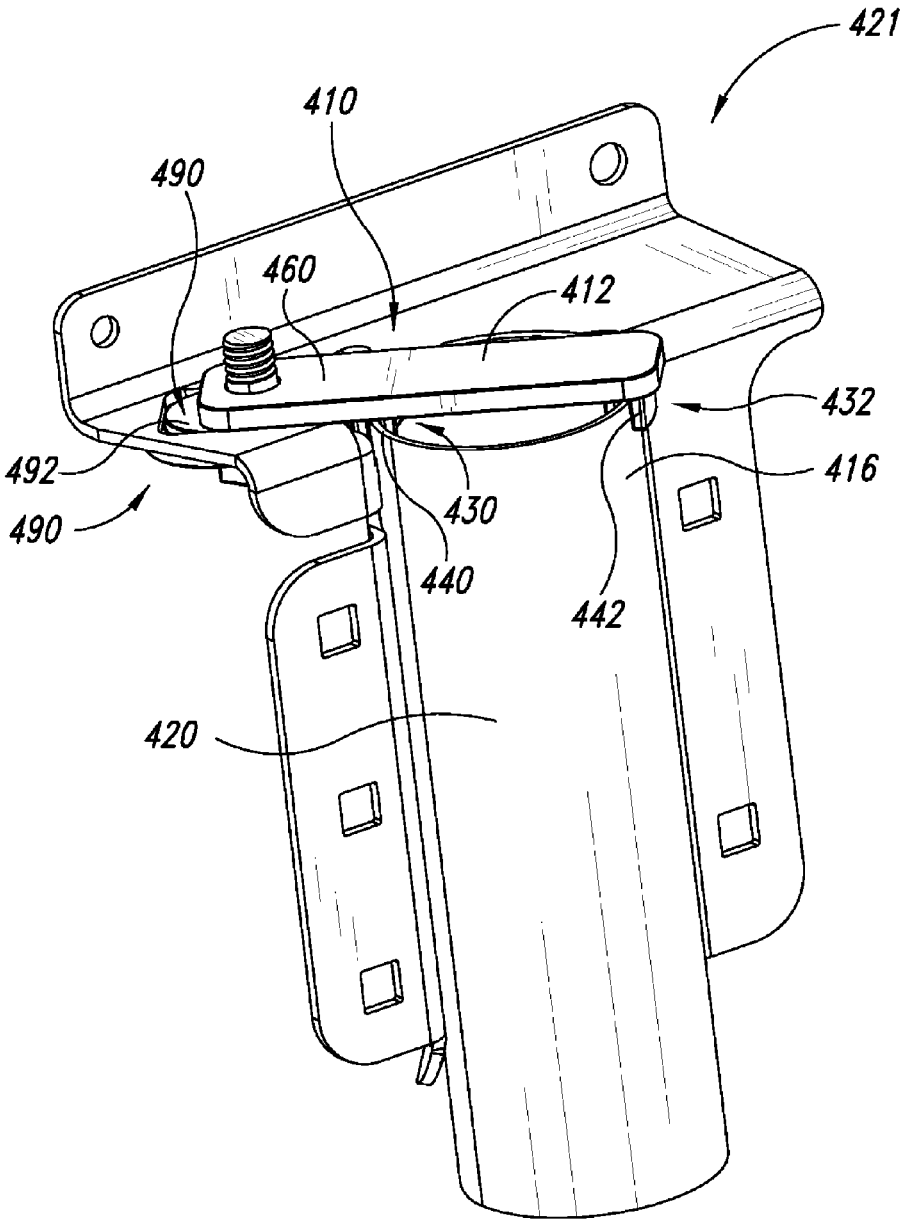
Figure 18:
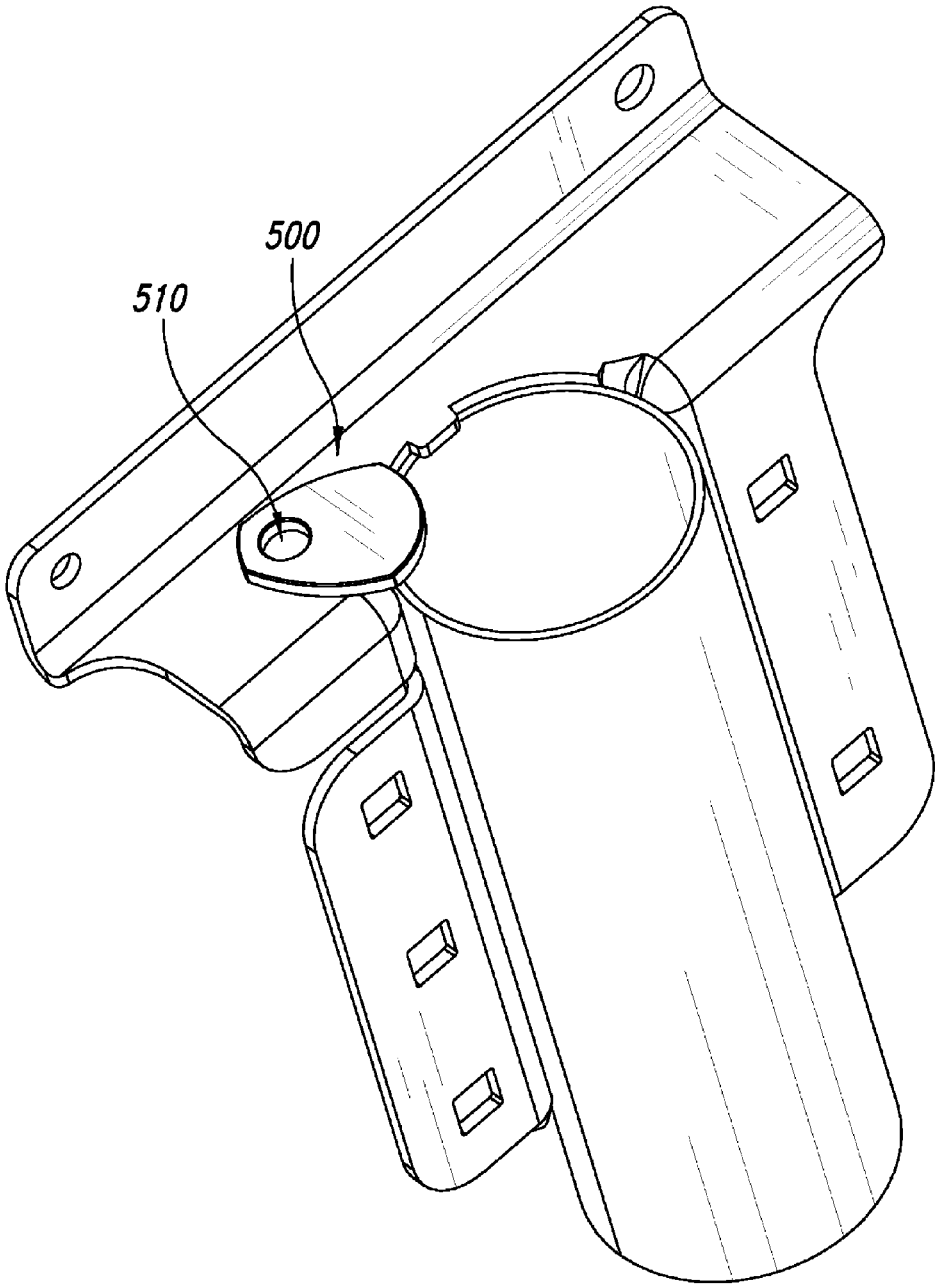
FIG. 18 is a pictorial view of portion of an antenna system of an alternative embodiment.

FIGS. 16-18 depict embodiments of antenna system components which may be generally similar to the embodiments discussed in connection with FIGS. 1-15, except as further detailed below. Many components of the antenna systems are shown removed.

FIGS. 16 and 17 show a clip 410 that has an elongated main body 412 extending across an upper end 416 of a mast 420.

FIG. 17 shows half of a bracket 421. Retainers 430, 432 of the clip 410 are coupled to opposing edge portions 440, 442 of the upper end 416. The edge portions 440, 442 are diametrically opposed to one another. The pair of retainers 430, 432 can cooperate to reduce or substantially eliminate sliding of the clip 410 along the upper end 416. The clip 410 can thus remain fixedly coupled to the mast 420 during operation of cam adjustment mechanisms. A portion 460 of the main body 412 extends outwardly from the upper end 416 and can hold a cam mechanism 490. At least a portion of a cam 492 of the cam mechanism 490 extends laterally outward from the clip 410.

The clips disclosed herein can have other shapes. For example, FIG. 18 shows an elongated clip 500 that tapers inwardly towards an opening 510 for receiving a shaft of a cam mechanism. Other shapes and configurations are also possible, if needed or desired.

In some embodiments, a method of positioning dish antennas disclosed herein includes providing a dish antenna, a mast, and a positioning apparatus coupled to the dish antenna. The dish antenna includes a dish and a feed horn. The positioning apparatus includes a cam holder and an eccentric cam. An upper end of the mast is positioned in a retainer of the cam holder such that a cantilevered main body of the cam holder extends outwardly from the upper end and carrying the eccentric cam. The eccentric cam is used to move the dish antenna while the cam holder is fixedly coupled to the mast. A user, in some embodiments, can manually rotate an outwardly protruding portion of the cam to rotate the dish antenna for fine tuning. Unless the context requires otherwise, throughout the specification and claims which follow, the word "comprise" and variations thereof, such as "comprises" and "comprising," are to be construed in an open, inclusive sense, that is as "including, but not limited to."

It should be noted that, as used in this specification and the appended claims, the singular forms "a," "an," and "the" include plural referents unless the context clearly dictates otherwise. It should also be noted that the term "or" is generally employed in its sense including "and/or" unless the context clearly dictates otherwise.

It will be appreciated that the illustrated embodiments can be located or oriented in a variety of desired positions, including various angles, sideways and even upside down. The antenna systems can be installed in a wide range of different locations and orientations. The adjustment mechanisms can be incorporated into a wide range of different types of movable apparatuses and used to move different components to adjust different settings, for example, elevational settings of antennas. The clips can be mounted to vertical masts, horizontal masts, or other structures in other orientations and thus used for elevation adjustments, azimuth adjustments, or both. The location and orientation of the clips, as well as other components of the adjustment mechanisms, can be selected based design of the antenna.

Various methods and techniques described above provide a number of ways to carry out the invention. There is interchangeability of various features from different embodiments disclosed herein. Similarly, the various features and acts discussed above, as well as other known equivalents for each such feature or act, can be mixed and matched by one of ordinary skill in this art to perform methods in accordance with principles described herein. Additionally, the methods which are described and illustrated herein, such as methods of installation, positioning, tuning, and the like, are not limited to the exact sequence of acts described, nor are they necessarily limited to the practice of all of the acts set forth. Other sequences of events or acts, or less than all of the events, or simultaneous occurrence of the events, may be utilized in practicing the embodiments of the invention.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, it is not intended that the invention be limited, except as by the appended claims.

What is claimed is:

1. A positioning system, comprising:

a support member having an upper edge portion; and a positioning mechanism including a clip fixedly coupled to a section of the upper edge portion of the member, the clip protruding outwardly from the support member, a cam mechanism rotatably coupled to the clip, and a bracket rotatably coupled to the support member and coupled to the cam mechanism with a coupling that permits the bracket to rotate with respect to the support member about an axis of rotation as the cam mechanism rotates.

2. The positioning system of claim 1, further comprising an antenna coupled to the bracket.

3. The positioning system of claim 2, wherein the antenna includes a dish and a feedhorn.

4. The positioning system of claim 1, wherein the clip holds a shaft of the cam mechanism to translationally fix the shaft with respect to the support member as the shaft rotates with respect to the clip.

5. The positioning system of claim 1, wherein a portion of the clip extends outwardly from the support member such that most of a longitudinal length of the portion of the clip is positioned between a retainer of the clip coupled to the support member and a shaft of the cam mechanism is rotatably coupled to the clip.

6. The positioning system of claim 1, wherein the clip has a first tab positioned on an interior side of the support member and a second tab positioned on an exterior side of the support member.

7. The positioning system of claim 1, wherein the cam mechanism includes an eccentric cam that is offset from an axis of rotation of the cam mechanism and positioned under a free end of the clip.

8. The positioning system of claim 1, wherein the positioning mechanism is configured to rotate the bracket about the axis a first angle as a cam of the cam mechanism rotates about a cam axis of rotation a second angle that is different from the first angle.

9. The positioning system of claim 8, wherein a ratio of the second angle to the first angle is greater than about 5.

10. A positioning mechanism, comprising:

an eccentric cam;

a clip pivotally coupled to the eccentric cam and fixedly coupled to a portion of a support member; and a positionable member rotatably coupled to the support member and adapted to engage the eccentric cam, at least a portion of the positionable member being positioned beneath the clip such that the positionable member moves relative to the support member as the eccentric cam rotates.

11. The positioning mechanism of claim 10, wherein the positionable member is a bracket for carrying an antenna.

12. The positioning mechanism of claim 10, wherein a portion of the clip extends radially outward from the support member such that most of a longitudinal length of the portion is positioned between the support member and a shaft of the eccentric cam.

13. The positioning mechanism of claim 10, wherein the clip, the eccentric cam, and the support member cooperate to rotate the positionable member a first angle about a first axis of rotation as the eccentric cam rotates a second angle about a second axis of rotation, and wherein the first angle is less than the second angle.

14. The positioning mechanism of claim 10, wherein the clip has a one-piece construction and comprises mostly a non-metal material.

15. A positioning apparatus, comprising:

a bracket assembly including a support bracket and a movable bracket;

a cam mechanism physically engaging the bracket assembly to move the movable bracket about a bracket axis to position a movable bracket with respect to the support bracket as the cam mechanism rotates about a cam axis of rotation; and a clip pivotally coupled to the cam mechanism and including a retainer adapted to receive and fixedly couple to the support bracket.

16. The positioning apparatus of claim 15, wherein the clip substantially fixes the cam axis of rotation with respect to the support bracket.

17. The positioning apparatus of claim 15, wherein the cam mechanism includes a cam and a shaft translationally fixed relative to the support bracket, the cam is configured to physically engage a cam follower of the support bracket, and the shaft pivotally connects the cam to the clip.

* * * * *